United States Patent [19]

Grendys

[11] Patent Number: 5,034,595

[45] Date of Patent: Jul. 23, 1991

[54] CARTRIDGE HEATER ASSEMBLY

[75] Inventor: Gary Grendys, Glenview, Ill.

[73] Assignee: Ogden Manufacturing Co., Arlington Heights, Ill.

[21] Appl. No.: 521,260

[22] Filed: May 9, 1990

[51] Int. Cl.[5] ..... H05B 3/08; H05B 3/52

[52] U.S. Cl. ..... 219/541; 219/544; 338/240; 338/274

[58] Field of Search ..... 219/544, 541, 335, 336, 219/523; 338/238-240, 243-251, 268, 273-274, 276, 326, 329

[56] References Cited

U.S. PATENT DOCUMENTS

| | | | |
|---|---|---|---|
| 1,282,476 | 10/1918 | Simon | 338/221 |
| 2,632,126 | 3/1963 | Curtis | 174/94 R |
| 2,659,795 | 11/1963 | Boggs | 338/238 |
| 3,197,617 | 7/1965 | Gillespie et al. | 219/541 |
| 3,225,321 | 12/1965 | Walter | 219/544 |
| 3,301,941 | 1/1967 | Christensen | 338/240 |
| 3,307,135 | 2/1967 | Simmons | 219/544 |
| 3,668,598 | 6/1972 | Drugmand et al. | 338/274 |
| 3,839,623 | 10/1974 | Portmann | 219/541 |
| 4,186,369 | 1/1980 | Attridge et al. | 219/541 |
| 4,287,502 | 9/1981 | Nickmeyer | 338/274 |
| 4,346,287 | 8/1982 | Desloge | 219/541 |
| 4,622,455 | 11/1986 | Schwarzkopf | 219/541 |
| 4,763,102 | 8/1988 | Ritt | 328/240 |

FOREIGN PATENT DOCUMENTS

| | | | |
|---|---|---|---|
| 1038795 | 10/1953 | France | 338/273 |

*Primary Examiner*—Bruce A. Reynolds
*Assistant Examiner*—John A. Jeffery
*Attorney, Agent, or Firm*—Welsh & Katz, Ltd.

[57] ABSTRACT

A cartridge heater, wherein the terminal lead pins which project from the terminal end of the heater at the outer surface of the electrical insulating end plug, are substantially reduced in length and provided with at least one flat planar surface on what was originally the cylindrical surface of each lead pin. The terminal ends of the external flexible lead wires are then fused to the flat surfaces on each of the lead pins by means of brazing, soldering or welding. An end adapter unit having two longitudinal bores is then threaded up over the two flexible lead wires until the outer casing, which encloses an electrical insulating core having the two circular bores for the flexible wires, is telescoped over the terminal end of the cannister which encloses the cartridge heater. The two bores within the end adapter are of a dimension sufficient not only to encompass the diameter of the flexible lead wire within each bore, but also of a diameter sufficient to enclose the fused end of the flexible lead wire and the foreshortened length of each lead pin. When the end adapter has been mounted on the outside surface of the cannister of the heating element, compressive force is applied by a conventional means, such as swaging, in order to compress the outer surface of the end adapter casing until its diameter is substantially equal to the diameter of the cannister of the electrical heater.

37 Claims, 2 Drawing Sheets

CARTRIDGE HEATER ASSEMBLY

BACKGROUND OF THE INVENTION

The present invention relates to electrical resistance heaters. More particularly, the present invention relates to an electrical cartridge heater assembly having improved electrical connection for the external lead wires.

Cartridge heaters typically comprise an electrical resistance element which is helically coiled on an insulating core. A metal cartridge or cannister that is coaxial with the coil and the core is radially spaced from the coil. The space between the cannister and the coil is filled with a mineral insulating material which has an optimum combination of a low electrical conductivity and a high thermal conductivity. In conventional cartridge heaters the mineral insulating material is typically a particulate material, such as a granular or powdered magnesium oxide, which is confined within the cannister by an insulating end plug.

Electrical power is delivered to the heater through a pair of conductors which are contained within longitudinal bores in the insulating core and are electrically connected to the resistance element. The conductors terminate in external lead pins which extend from the core outwardly through the end plug of the electrical heater. The end terminals of the helically coiled resistance element extend into the longitudinal bores in the core where they are held in electrical contact with the conductors. Opposite ends of the helically coiled resistance element are connected to different conductors so that the electrical power can be supplied to the coil. The lead pins which extend from the outer end of the conductors are conventionally solid as opposed to being of stranded wire in order to minimize surface area and thereby avoid the detrimental affects of surface oxidation. The use of solid conductors with terminating solid lead pins also makes the cartridge heater assembly reasonably rigid and provides for easy centering of the internal elements so that the assembly can be more easily fabricated.

In typical cartridge heaters, each lead pin extends outwardly from the terminal end of the heater with the outward extension of the lead pin being adapted to be electrically connected to an external lead, which is typically a flexible lead wire. Because the lead pins are generally lengthy, the electrical connections between the lead pins and the external lead wires are typically enclosed in an extension which occupies a relatively large amount of space at the end of the heater, thereby adding to the unheated length of the cartridge heater assembly. Such cartridge heater assemblies having a large unheated length on the terminal end are exemplified by U.S. Pat. No. 3,839,623 to Portmann; U.S. Pat. No. 4,287,502 to Nickmeyer; and U.S. Pat. No. 4,622,455 to Schwarzkopf.

This additional unheated length is undesirable because it acts as a heat sink, causes an uneven heat flux and temperature distribution along the length of the heater, reduces the wattage output of the heater in those applications where the length of the heater is limited, and prevents use of the heater in certain applications where space limitations are tight.

In U.S. Pat. No. 4,346,287 to Desloge, the inventor seeks to avoid the disadvantages of the prior art by providing the connections between the heater lead pins and the flexible external lead wires internally within the insulating end plug of the cartridge heater. In order to accomplish this, the lead pin and the insulating end plug are drilled out to provide cylindrical bores into which the terminal ends of the lead wires are inserted for a lapped connection. The primary problem with this concept is that it requires high precision drilling in order to provide a concave surface in each lead pin, which is, of course, expensive. Moreover, the inventor discloses numerous embodiments wherein he does, in fact, add additional enclosures and extensions over the terminal connection of the lead pins and the external lead wires, which thus defeats his original purpose of eliminating the additional unheated length to the cartridge heater.

With this then being the state of the art, it is an object of the present invention to provide an electrical heater assembly having secure terminal connections between the heater lead pins and the terminal ends of the external lead wires.

It is another object of the present invention to provide such secured connections within an end assembly which minimizes the amount of unheated length which is added to the terminal end of the electrical heater assembly.

It is a further object of the present invention to provide the foregoing objects without the additional expense of high precision machine operations.

These and other objects of the present invention, as well as the advantages thereof, will become more clear from the disclosure which follows.

SUMMARY OF THE INVENTION

The foregoing objects of the present invention are achieved by the provision of a conventional electrical heater assembly such as a cartridge heater, wherein the terminal lead pins which project from the terminal end of the heater at the outer surface of the electrical insulating end plug, are substantially reduced in length and provided with at least one flat planar surface on what was originally the cylindrical surface of each lead pin. The provision of the flat planar surface or face on the otherwise cylindrical sides of the lead pins may be accomplished by any low precision operation such as grinding, shearing, pressing, punching or planing. The terminal ends of the external flexible lead wires are then fused to the flat surfaces on each of the lead pins by means of brazing, soldering or welding. An end adapter unit having two longitudinal bores is then threaded up over the two flexible lead wires until the outer casing, which encloses an electrical insulating core having the two circular bores for the flexible wires, is telescoped over the terminal end of the cannister which encloses the cartridge heater. The two bores within the end adapter are of a dimension sufficient not only to encompass the diameter of the flexible lead wire within each bore, but also of a diameter sufficient to enclose the fused end of the flexible lead wire and the foreshortened length of each lead pin. When the end adapter has been mounted on the outside surface of the cannister of the heating element, compressive force is applied by a conventional means, such as swaging, in order to compress the outer surface of the end adapter casing until its diameter is substantially equal to the diameter of the cannister of the electrical heater.

Accordingly, in its apparatus aspects, the present invention comprehends an electrical heater assembly which includes an electrical heating element within an encompassing heating element cannister which surrounds the heating element and is spaced therefrom.

The cannister has an open end which contains an electrical insulating end plug having an outer face coterminous with the cannister open end. The end plug confines the heating element and an insulating means within the cannister, the insulating means typically being granulated magnesium oxide. A first conductor means is positioned within the cannister in electrical contact with a first end of the heating element, isolated from the cannister, extending through the insulating end plug, and terminating in a first electrical lead pin outside of the cannister and the end plug. A second conductor means is also confined within the cannister in electrical contact with the other end of the heating element, isolated from the cannister and from the first conductor means, extending through the insulating end plug, and terminating in a second electrical lead pin outside of the cannister and the end plug, with the second lead pin being spaced from the first lead pin. A first flat planar surface is provided on the first lead pin and a second flat planar surface is provided on the surface of the second lead pin. A first elongated external lead conductor having a terminal end in electrical contact with the first lead pin is secured on the first flat planar surface, this lead conductor having a jacketed length including a compressible insulating jacket extending from the terminal end. Similarly, a second elongated external lead conductor having a terminal end is in electrical contact with the second lead pin on the second flat planar surface, the second elongated external lead conductor having a jacketed length including a compressible insulating jacket extending from the terminal end. An end adapter casing has a first end mounted on the outer surface of the heating element cannister at the cannister open end over at least a portion of the insulating end plug, and it extends from the cannister and the outer face of the end plug to provide a casing second end. An end adapter electrical insulating core is confined within this casing, and it has an inner face in contact with the outer face of the heating element insulating end plug, and an outer face coterminous with the second end of the end adapter casing. A first bore in the end adapter insulating core extends from its outer face to its inner face and confines therein the first lead pin, the terminal end of the first elongated external lead conductor, and a terminal portion of the jacketed length of the first elongated external lead conductor. Finally, a second bore is found in the end adapter insulating core extending from its outer face to its inner face and confining therein the second lead pin, the terminal end of the second elongated external lead conductor, and a terminal portion of the jacketed length of the second elongated external lead conductor.

A clearer understanding of the present invention will be obtained from the disclosure which follows when read in light of the accompanying drawings.

DESCRIPTION OF THE PREFERRED EMBODIMENTS

Figure 1:
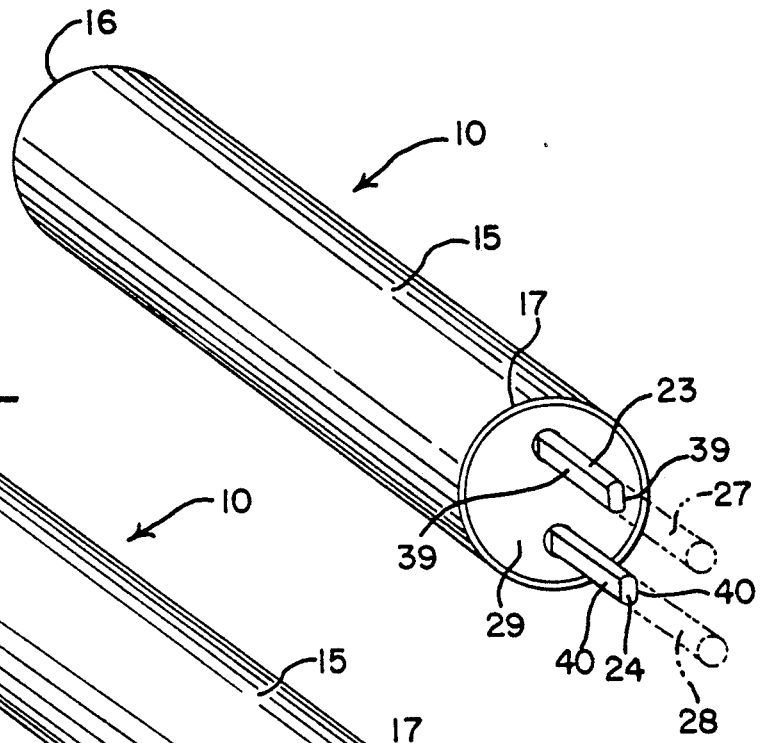
FIG. 1 is a simplified schematic representation of a cartridge heater having a conventional structure, but wherein the cylindrical lead pins have been shortened and flat planar surfaces have been provided on each side of the originally cylindrical lead pins.

Referring now to FIG. 1, there is shown a typical cartridge heater body 10. Cartridge heater body 10 has a tubular outer housing or cannister 15, typically of metal, which has a closed end 16 and an open end 17. The open end 17 contains an internal electrical insulating end plug 29 which has an outer face which is coterminous or flush with the open end 17 of the cannister 15. An upper lead pin 23 and a lower lead pin 24 extend from the outer face of the insulating end plug 29. The upper lead pin 23 is formed by processing an original lead pin 27, shown in dotted line, which had an extended length and a cylindrical shape. The original lead pin 27 was reduced in length and then processed to provide a flat planar surface or face 39 on each side, front and back, of the lead pin in order to produce the resulting upper lead pin 23. Similarly, the lower lead pin 24 is formed by processing an original lead pin 28, shown in dotted line, which had an extended length and cylindrical shape. The original lead pin 28 was reduced in length and then processed to provide a flat planar surface or face 40 on each side in order to produce the resulting lower lead pin 24. Any conventional process may be used to provide the flat faces 39 on upper lead pin 23 and the flat faces 40 on the lower lead pin 24, such as grinding, shearing and planing. However, shearing is the preferred technique, and high precision is not necessary in order to produce the flat faces.

Figure 2:
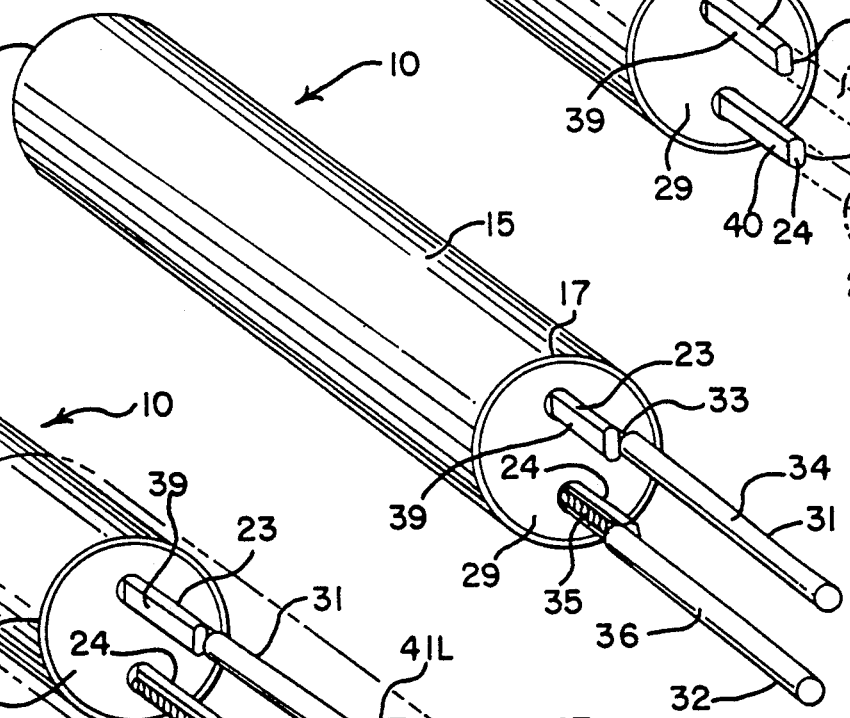
FIG. 2 is a simplified schematic representation wherein flexible external lead wires have been attached to a flat planar surface on each of the lead pins of the cartridge heater of FIG. 1.

The next step in producing the cartridge heater of the present invention requires the attachment of flexible external lead wires to the upper and lower lead pins. This is illustrated in FIG. 2 wherein there is shown an upper flexible external lead wire 31 attached to the back face 39 of the upper lead pin 23. Similarly, a lower flexible external lead wire 32 is attached to the front face 40 of the lower lead pin 24. The upper flexible external lead wire 31 comprises an exposed end of a plurality of twisted strands of metal wire 33 contained within a flexible insulating jacket 34. This jacket is made of a compressible fabric or synthetic material, such as an elastomeric polymer which is molded or extruded around the strands of twisted metal wire 33. Similarly, the lead wire 32 has a terminal end of an exposed plurality of twisted strands of metal wire 35 which are contained within a flexible insulating jacket 36. The flexible insulating jacket 36 is also made of a compressible fabric or synthetic material, such as an elastomeric polymer which is molded or extruded around the strands of twisted metal wire 35. Any conventional means of attachment for the terminal ends of the wires 33 and 35 to the upper and lower lead pins may be utilized, such as brazing, soldering or welding. However, it is preferred to spot weld the exposed terminal end of the twisted wire 33 to the upper lead pin 23 and the exposed terminal end of the twisted wire 35 to the lower lead pin 24.

Figure 3:
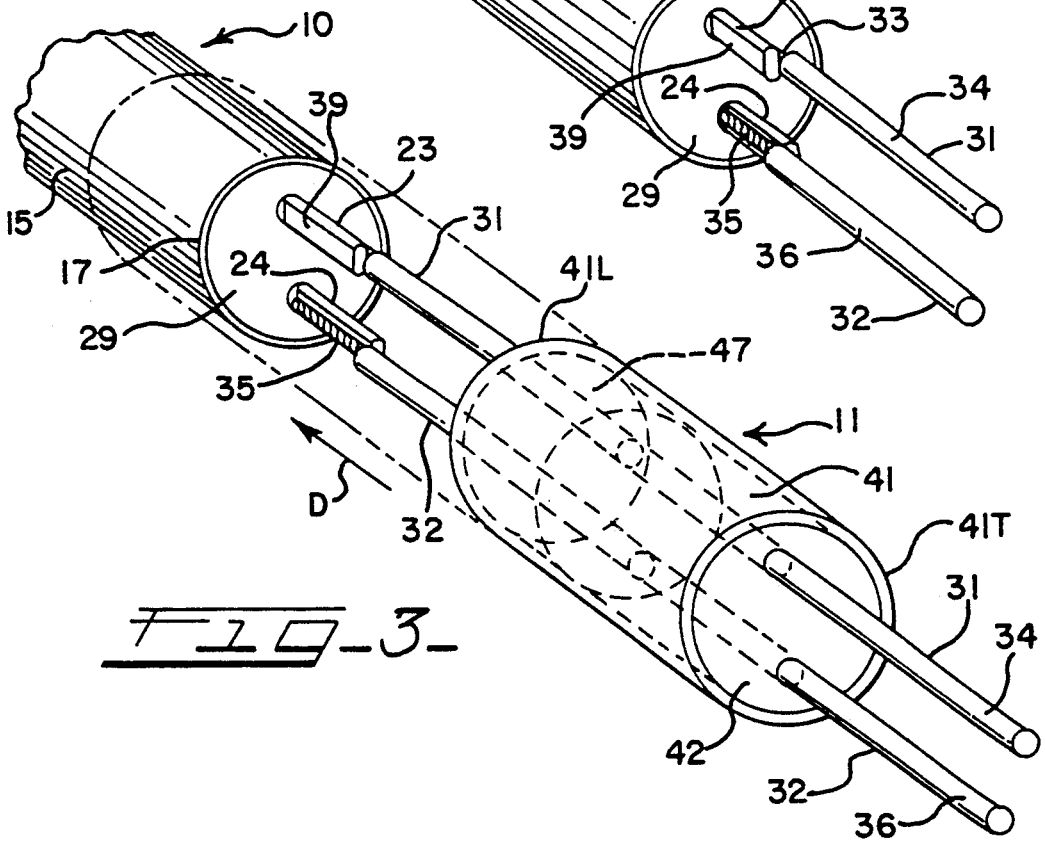
FIG. 3 is a simplified schematic representation showing the terminal end of the cartridge heater of FIG. 2 wherein an end adapter unit is slid along the length of the flexible external lead wires so that the outer casing of the end adapter can be mounted on the external surface of the heater cannister and the lead wire bores of the core end of the end adapter unit can encompass the terminal connections between the lead pins and the flexible external lead wires.

With the terminal connections having been made for the upper flexible external lead wire 31 with upper lead pin 23 and the lower flexible external lead wire 32 with the lower lead pin 24, as shown in FIG. 2, it can be seen that the terminal connections are exposed on the end of the heater. Accordingly, they are vulnerable to abuse and damage which may be occasioned by normal handling and use. Therefore, as shown in FIG. 3, an end adapter 11 is mounted over the terminal end of the cartridge heater body 10. The end adapter 11 has an outer casing 41, typically of metal, which encloses an electrical insulating end plug or core 42 which is typically made of mica, although other materials such as lava and compressible ceramic may be used. The mica end plug or core has an outer face which is coterminous with the trailing end 41T of the casing 41 and an inner face which is recessed within the casing 41 as shown by the open recess 47 within the end adapter 11.

The core 42 contains an upper bore hole and a lower bore hole which pass completely through the core. This allows the end adapter 11 to be mounted on the heater body lo by threading the flexible external lead wires through the bore holes. As shown in FIG. 3, the upper lead wire 31 is threaded through the upper bore hole of the core 42 and the lower lead wire 32 is threaded through the lower bore hole. The end adapter 11 is then slid along the flexible lead wires 31 and 32 in the direction of the arrow D until the leading end 41L of the casing 41 passed over the open end 17 of the heater cannister 15, and the inside face of the core 42 is pressed flush against the outside face of the end plug 29 of the cartridge heater body 10.

The inside diameter of the bore holes in the insulating core 42 of the end adapter 11 have a diameter sufficient not only to allow for sliding of the flexible external lead wires 31 and 32 therethrough, but the diameter is also sufficient to allow the bore holes to contain the terminal connections of the flexible lead wire 31 with the upper lead pin 23 and the flexible lead wire 32 with the lower lead pin 24. The phantom line in FIG. 3 shows that the open end of the casing 41 which contains the recess 47 will slide over the outside surface of the cannister 15 of the cartridge heater body 10 to thereby mount casing 41 on cannister 15 and allow the inner face of the core 42 to become flush tight against the outer face of the end plug 29. The resulting assembly of the cartridge heater body 10 and the end adapter 11 will be more clearly seen in FIG. 4, where the assembly is shown partially cut away and in section.

Figure 4:
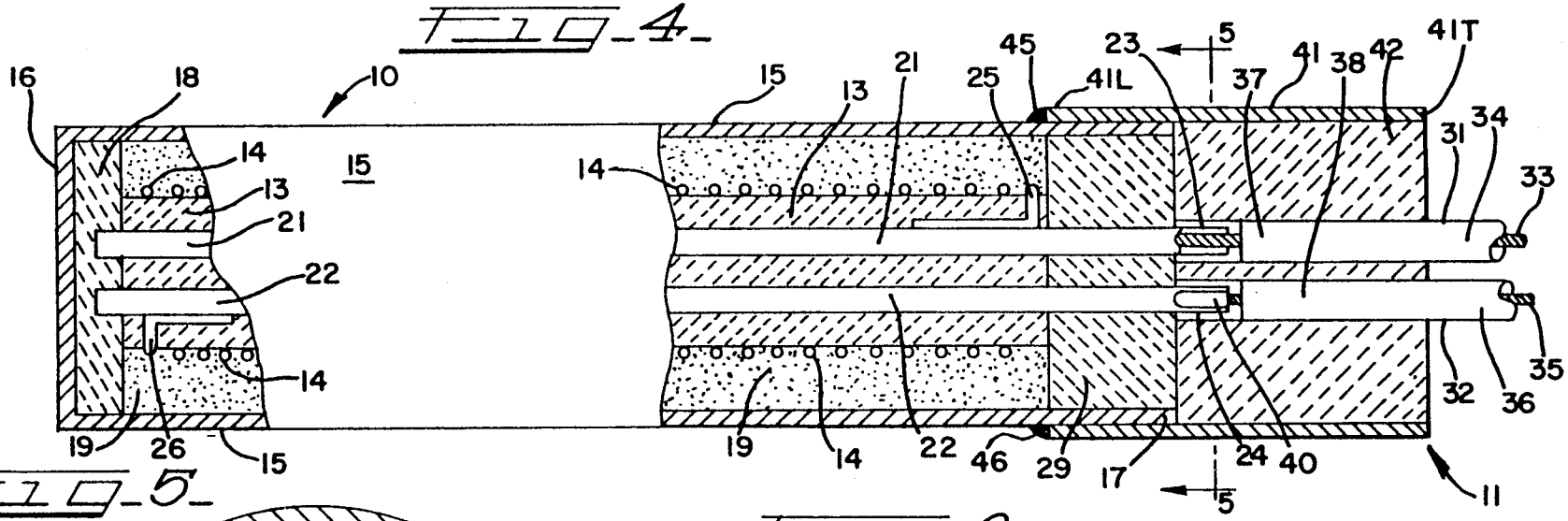
FIG. 4 is a simplified schematic representation of the structure of the cartridge heater assembly of FIG. 3, shown after completion of the assembly operation.

Referring now to FIG. 4, there is seen the electrical cartridge heater body 10 on which the end adapter 11 has been mounted at the terminal end. The cartridge heater body 10 contains a ceramic core 13 upon which there is helically wound a heating coil 14 of a resistance wire. The metal cartridge or cannister 15 encompasses the ceramic core and the helical heating coil 14. The cannister 15 has a closed end 16 and an open end 17. At the closed end 16 there is located a centering end plug 18 which will be discussed more fully hereinafter. At the open end of the cannister 15 there is contained an internal electrical insulating end plug 29 of a refractory material having a high technical strength in the compressed state. The internal insulating end plug 29 confines a particulate electrical insulating material 19 in the space between the cannister 15 and the ceramic core 13. The particulate insulating material is typically magnesium oxide, and the insulating end plug is typically made of lava, although other materials such as mica and compressible ceramic may be used.

The ceramic core 13 contains an elongated longitudinal upper bore and an elongated longitudinal lower bore extending therethrough. The upper bore contains an upper internal conductor lead 21 of a metal rod and the lower bore contains a lower internal conductor lead 22 of a metal rod. Each of the conductor leads 21 and 22 extends to the closed end 16 of the electrical cartridge heater body 10 where it is seated in the centering end plug 18. The other end of the upper and lower internal conductor leads 21 and 22 extends through the internal electrical insulating end plug 29. In this manner the conductor leads 21 and 22 keep the core 13 and the helical coil 14 of resistance heating wire centered within the cannister 15. The upper internal conductor lead 21 terminates in the upper lead pin 23 and the lower conductor lead 22 terminates in the lower lead pin 24. The helical heating coil 14 has an upper coil end 25 in contact with the upper internal conductor lead 21 at the open end 17 of the cannister 15. In a similar manner, the helical heating coil 14 has a lower coil end 26 which is in contact with the lower internal conductor 22 at the closed end 16 of the cannister 15.

It can be seen in FIG. 4 that the end adapter 11 has been mounted on the electrical cartridge heater body 10 in such a manner that the end adapter casing 41 extends onto the outside surface of the metal cannister 15 for a distance which is sufficient to completely overlap the internal insulating end plug 29. This causes the recess 47 of the end adapter 11 (shown in FIG. 3) to be completely filled by the open end 17 of the electrical cartridge heater body 10, and the inner face of the end adapter core 42 is abutted tightly against the outer face of the internal electrical insulating end plug 29, as previously discussed in regard to FIG. 3. Alternatively, the end adapter 11 may be designed so that the leading end 41L of the casing 41 will mount on cannister 15 beyond the end plug 29 or it may mount on cannister 15 so that only a portion of casing 41 extends over the end plug 29. However, it is preferred that casing 41 extend over the full length of end plug 29, as shown.

Figure 5:
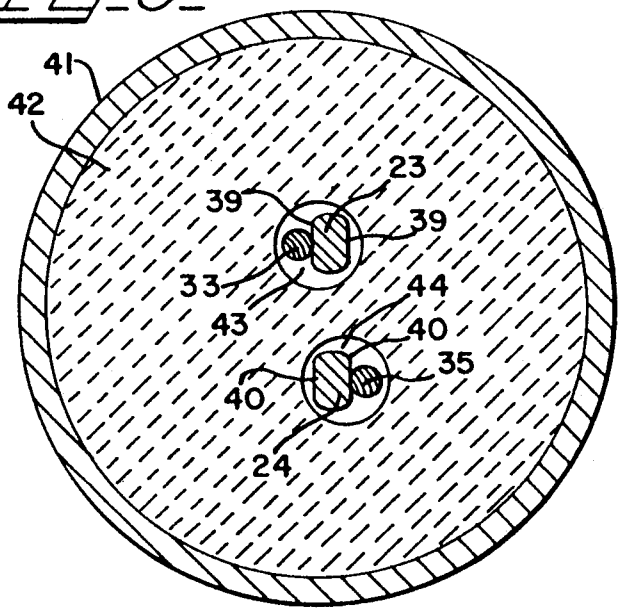
FIG. 5 is a simplified schematic representation of the heater assembly of FIG. 4, shown in cross section, as taken along section line 5—5 in FIG. 4.

Referring now to both FIGS. 4 and 5, it will be seen that the upper adapter bore 43 in the mica core 42 contains the upper flexible external lead wire 31 which is made of the plurality of twisted strands of metal wire 33 within the flexible insulating jacket 34 of compressible fabric or synthetic polymer. Similarly, the lower adapter bore 44 in the mica core 42 contains the lower flexible external lead wire 32 which is made up of the plurality of twisted strands of metal wire 35 encompassed by the flexible insulating jacket 36 of compressible fabric or synthetic material. As seen most clearly in FIG. 4, a terminal end portion 37 of the compressible jacket 34 of wire 31 is contained in the upper bore 43, and a terminal end portion 38 of the jacket 36 of the wire 32 is contained in the lower bore 44. The terminal end of the twisted strands of lead wire 33 is attached to a flat planar surface 39 of the upper lead pin 23 within bore 43, and the terminal end of the twisted strands of lead wire 35 is attached to a flat planar surface 40 of the lower lead pin 24 within the bore 44. This is seen most clearly in FIG. 5.

As also seen most clearly in FIG. 5, the terminal end of the twisted strands of lead wire 33 of the flexible external lead 31 is spot welded to the front face 39 of the upper lead pin 23, and the terminal end of the twisted strands of wire 35 of flexible external lead 32 is spot welded to the back face 40 of the lower lead pin 24. This orientation is the reverse of what has been shown in FIGS. 2 and 3, and it has been made merely for purposes of illustration in order to show that the position of the terminal ends of the flexible external lead wires is not critical. In fact, both the upper and lower flexible lead wires could be attached to the upper and lower lead pins on the same side of the lead pins, either on the front or on the back. However, it is preferred to orient the lead wires as shown in FIG. 2 or in FIG. 5 so that they are, in fact, on opposite sides.

In order to fixedly attach the casing 41 to the cannister 15, the assembly is spot welded as shown at 45 and 46. Although the spot welding may extend around the entire circumference of the cannister 15 and the casing 41, it is only necessary to spot weld these two metal tubes in an upper location 45 and a lower location 46, as shown, so that there are only two spot welds located 180° apart from each other.

Figure 6:
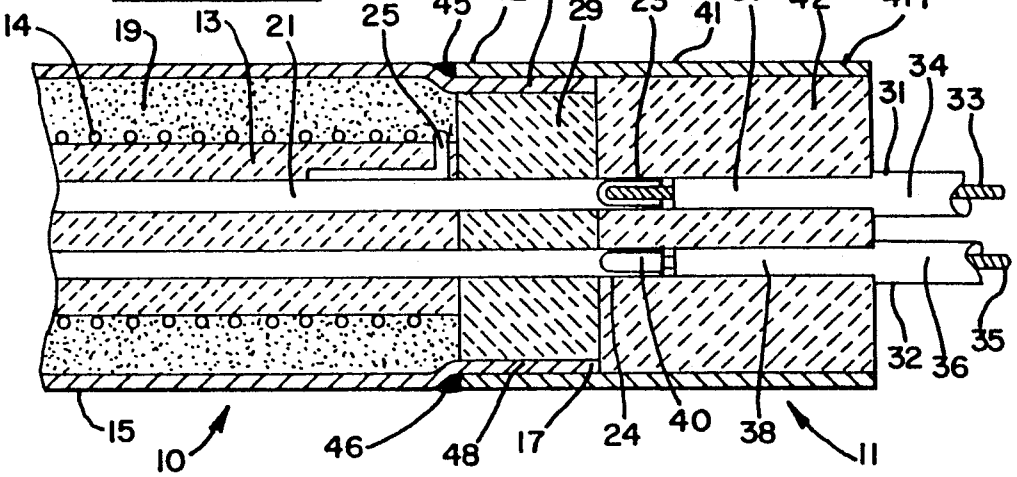
FIG. 6 shows the terminal end of the cartridge heater assembly of FIG. 4 after a compressive force has been applied on the end adapter to bring the outer diameter of the end adapter to the same dimension as the outer diameter of the heater cannister.

In order to further secure the casing 41 on the cannister 15, it is desirable and preferred to apply a compressive force around the entire surface of the casing 41. This is typically performed by swaging, and this operation results in a finished cartridge heater assembly, as shown in FIG. 6, where only the terminal end of the assembly is shown. The compressive force is applied until the outer diameter of the casing 41 has been reduced so that it is substantially equivalent to the nominal outer diameter of the cannister 15. When this operation has been performed, a compressive set is retained by the metal casing 41 and a necked down portion 48 is found at the open end 17 of the metal cannister 15. This means that there is a compression of the insulating end plug 29 and the insulating core 42. This also causes the internal diameter of the adapter bores 43 and 44 of the core 42 to be reduced in size. Accordingly, the terminal end portions 37 and 38 of the compressible, flexible insulating jackets 34 and 36, respectively, are held in a compressed state within the core 42, as seen in FIG. 6, thereby to further immobilize, retain and secure the upper and lower flexible external lead wires 31 and 32 to the finished electrical cartridge heater assembly.

It is to be understood that the dimensions which are illustrated in FIGS. 4 through 6 are exaggerated in order to provide clarity for an understanding of the invention. The dimensions are not as great as what has been illustrated. Typically, the thickness of the casing 41 is about 0.010 inch and the thickness of the cannister 15 is from about 0.020 to about 0.035 inch. The longitudinal thickness of the internal electrical insulating end plug 29 is typically only about 0.125 inch and the longitudinal thickness of the core 42 is only about 0.250 inch. This means that the overlap portion of the casing 41 and the necked down portion 48 of cannister 15 have a dimension of only 0.125 inch. Also, the upper and lower lead pins 23 and 24 have a finished length of only 0.125 inch. Thus, the end adapter does not add an extensive length to the finished electrical cartridge heater assembly, since the overall addition is only 0.250 inch (¼ inch). Accordingly, the additional unheated length is minimized and the deficiencies of the prior art patents having elongated unheated ends are minimized, if not totally avoided, in regard to the problems hereinabove discussed.

Those skilled in the art can readily perceive that by providing the flat planar surfaces 39 on upper lead pin 23 and the flat planar surfaces 40 on lower lead pin 24, the step of spot welding the terminal ends of the twisted wire strands 33 and 35 of the flexible lead wires 31 and 32 is made much easier, since it is difficult to hold a cylindrical wire twist steady on a cylindrical lead pin surface for welding. Although only one flat surface is needed on each lead pin, it is preferred to provide two flat surfaces on each lead pin as shown, since this minimizes the need to twist and turn the cartridge heater body in order to properly position it for the spot welding of the flexible wire leads to the lead pins.

Although the foregoing disclosure of the present invention has been made in regard to an electrical heater assembly relating to a cartridge heater having an elongated tubular cannister for confinement of the heating element, the invention is not so limited. The confining housing or enclosure may have any suitable shape. For example, the resistance wire heating element may be an elongated element contained within a tubular housing having the shape of a U-tube or it may have a circular tubular shape.

In the light of the foregoing disclosure, further alternative embodiments of the inventive cartridge heater assembly will undoubtedly suggest themselves to these skilled in the art. It is thus intended that the disclosure be taken as illustrative only, and that it not be construed in any limiting sense. Modifications and variations may be resorted to without departing from the spirit and the scope of this invention, and such modifications and variations are considered to be within the purview and the scope of the appended claims.

The invention claimed:

1. An electrical heater assembly which comprises:

(a.) an electrical heating element;

(b.) an encompassing heating element cannister surrounding said heating element and spaced therefrom, said cannister having an open end;

(c.) electrical insulating means confined within said cannister between said heating element and end cannister;

(d.) an electrical insulating end plug within said cannister open end and having an outer face coterminous with said cannister open end, said end plug confining said heating element and said insulating means within said canister;

(e.) first conductor means within said cannister in electrical contact with a first end of said heating element, isolated from said cannister, extending through said insulating end plug, and terminating in a first electrical lead pin outside of said cannister and said end plug;

(f.) second conductor means within said cannister in electrical contact with a second end of said heating element, isolated from said cannister and from said first conductor means, extending through said insulating end plug, and terminating in a second electrical lead pin outside of said cannister and said end plug, with said second lead pin being spaced from said first lead pin;

(g.) a first flat planar surface on said first lead pin and a second flat planar surface on said second lead pin;

(h.) a first elongated external lead conductor having a terminal end fixedly attached in electrical contact with said first lead pin on said first flat planar surface and having a jacketed length including a compressible insulating jacket extending from said terminal end;

(i.) a second elongated external lead conductor having a terminal end fixedly attached in electrical contact with said second lead pin on said second flat planar surface and having a jacketed length including a compressible insulating jacket extending from said terminal end;

(j.) an end adapter casing having a first end mounted on the outer surface of said heating element cannister at the cannister open end over at least a portion of said insulating end plug, and extending from said cannister and the outer face of said end plug to provide an unmounted casing second end;

(k.) an end adapter electrical insulating core confined within said casing, having an inner face in contact with the outer face of said heating element insulating end plug, and having an outer face coterminous with the second end of said end adapter casing;

(l.) a first bore of substantially constant diameter in said end adapter insulating core extending from its outer face to its inner face and confining therein said first lead pin, the terminal end of said first elongated external lead conductor, and a terminal portion of the jacketed length of said first elongated external lead conductor; and, (m.) a second bore of substantially constant diameter in said end adapter insulating core extending from its outer face to its inner face and confining therein said second lead pin, the terminal end of said second elongated external lead conductor, and a terminal portion of the jacketed length of said second elongated external lead conductor.

2. An electrical heater assembly according to claim 1 wherein said electrical heating element is longitudinally extended from said heating element end plug and said heating element cannister is longitudinally extended from its open end.

3. An electrical heater assembly according to claim 2 wherein said electrical heating element comprises a helical coil structure.

4. An electrical heater assembly according to claim 2 wherein said heating element cannister comprises an elongated cylindrical structure having a closed end spaced from said open end.

5. An electrical heater assembly according to claim 1 wherein said electrical insulating means has a low electrical conductivity and a high thermal conductivity.

6. An electrical heater assembly according to claim 5 wherein said electrical insulating means comprises a particulate material.

7. An electrical heater assembly according to claim 1 wherein said first flat planar surface on said first lead pin faces in a first direction and said second flat surface on said second lead pin faces in a second 180° from said first direction.

8. An electrical heater assembly to claim 1 wherein said first flat planar surface on said first lead pin faces in a first direction and another flat planar surface is located on said first lead pin facing in a second direction 180° from said first direction.

9. An electrical heater assembly according to claim 8 wherein said second flat planar surface of said second lead pin faces in said second direction and another flat planar surface is located on said second lead pin facing in said first direction.

10. An electrical heater assembly according to claim 1 wherein said terminal end of the first elongated external lead conductor is maintained in contact with sad first lead pin by a method selected from the group consisting of brazing, soldering and welding.

11. An electrical heater assembly according to claim 10 wherein said terminal end of the second elongated external lead conductor is maintained in contact with said second lead pin by a method selected from the group consisting of brazing, soldering and welding.

12. An electrical heater assembly according to claim 1 wherein said end adapter casing has an outer dimension substantially equal to the outermost dimension of said heating element cannister.

13. An electrical heater assembly according to claim 12 wherein said end adapter casing has a permanent set which has been retained after the release of compressive force which was imposed upon said casing in order to achieve said outer dimension, and that portion of said cannister underlying said casing is a necked down portion of said cannister having a permanent set which has been retained after the release of said imposed compressive force.

14. An electrical heater assembly according to claim 13 wherein said heating element end plug portion underlying said casing is in a compressed state, said end adapter insulating core underlying said casing is in a compressed state, and said insulating jacket on the terminal portion of the jacketed length of said first and second elongated external lead conductors are in a compressed state within said first and second bores as a result of said imposed compressive force.

15. An electrical heater assembly according to claim 1 wherein said end adapter casing is attached to said heating element cannister by a method selected from the group consisting of brazing, soldering and welding.

16. An electrical heater assembly according to claim 15 wherein said casing is attached to said cannister in a first location and in a second location 180° from said first location.

17. An electrical heater assembly which comprises:

(a.) an electrical heating element contained within a confining housing and having a first end and a second end;

(b.) first conductor means in electrical contact with said first end of said heating element, and terminating in a first electrical lead pin;

(c.) second conductor means in electrical contact with said second end of said heating element, and terminating in a second electrical lead pin, with said second lead pin being proximate to said first lead pin;

(d.) a first flat planar surface on said first lead pin and a second flat planar surface on said second lead pin;

(e.) a first elongated external lead conductor having a terminal end fixedly attached in electrical contact with said first lead pin on said first flat planar surface and having a jacketed length including a compressible insulating jacket extending from said terminal end;

(f.) a second elongated external lead conductor having a terminal end fixedly attached in electrical contact with said second lead pin on said second flat planar surface and having a jacketed length including a compressible insulating jacket extending from said terminal end;

(g.) an end adapter casing having a first end mounted on the outer surface of said heating element housing and extending from said housing to provide an unmounted casing second end;

(h.) an end adapter electrical insulating core confined within said casing, having an inner face adjacent said heating element housing and having an outer face coterminous with the second end of said end adapter casing;

(i.) a first bore of substantially constant diameter in said end adapter insulating core extending from its outer face to its inner face and confining therein said first lead pin, the terminal end of said first elongated external lead conductor, and a terminal portion of the jacketed length of said first elongated external lead conductor; and, (j.) a second bore of substantially constant diameter in said end adapter insulating core extending from its outer face to its inner face and confining therein said second lead pin, the terminal end of said second elongated external lead conductor, and a terminal portion of the jacketed length of said second elongated external lead conductor.

18. An electrical heater assembly according to claim 17 wherein said heating element housing comprises an elongated tubular structure.

19. An electrical heater assembly according to claim 17 wherein said first flat planar surface on said first lead pin faces in a first direction and said second flat planar surface on said second lead pin faces in a second direction 180° from said first direction.

20. An electrical heater assembly according to claim 17 wherein said first flat planar surface on said first lead pin faces in a first direction and another flat planar surface is located on said first lead pin facing in a second direction 180° from said first direction.

21. An electrical heater assembly according to claim 20 wherein said second flat planar surface on said second lead pin faces in said second direction and another flat planar surface is located on said second lead pin facing in said first direction.

22. An electrical heater assembly according to claim 17 wherein said terminal end of the first elongated external lead conductor is maintained in contact with said first lead pin by a method selected from the group consisting of brazing, soldering and welding.

23. An electrical heater assembly according to claim 22 wherein said terminal end of the second elongated external lead conductor is maintained in contact with said second lead pin by a method selected from the group consisting of brazing, soldering and welding.

24. An electrical heater assembly according to claim 17 wherein said end adapter casing has an outer dimension substantially equal to the outermost dimension of said heating element housing.

25. An electrical heater assembly according to claim 24 wherein said end adapter casing has a permanent set which has ben retained after the release of compressive force which was imposed upon said casing in order to achieve said outer dimension, and that portion of said housing underlying said casing is a necked down portion of said housing having a permanent set, which has been retained after the release of said imposed compressive force.

26. An electrical heater assembly according to claim 25 wherein said end adapter insulating core underlying said casing is in a compressed state, and said insulating jacket on the terminal portion of the jacketed length of said first and second elongated external lead conductors are in a compressed state within said first and second bores as a result of said imposed compressive force.

27. An electrical heater assembly according to claim 17 wherein said end adapter casing is attached to said heating element housing by a method selected from the group consisting of brazing, soldering and welding.

28. An electrical heater assembly according to claim 27 wherein said casing is attached to said housing in a first location and in a second location 180° from said first location.

29. An electrical heater assembly which comprises:

(a.) an electrical heating element contained within a confining housing and having a first end and a second end;

(b.) first conductor means in electrical contact with said first end of said heating element, and terminating in a first electrical lead pin;

(c.) second conductor means in electrical contact with said second end of said heating element, and terminating in a second electrical lead pin, with said second lead pin being proximate to said first lead pin;

(d.) a first flat planar surface on said first lead pin and a second flat planar surface on said second lead pin;

(e.) a first elongated external lead conductor having a terminal end fixedly attached in electrical contact with said first lead pin on said first flat planar surface and having a jacketed length including a compressible insulating jacket extending from said terminal end;

(f.) a second elongated external lead conductor having a terminal end fixedly attached in electrical contact with said second lead pin on said second flat planar surface and having a jacketed length including a compressible insulating jacket extending from said terminal end;

(g.) an end adapter casing having a first end mounted over said first and second lead pins and extending therefrom to provide an unmounted casing second end;

(h.) an end adapter electrical insulating core confined within said casing, having an inner face encompassing said first and second lead pins, and having an outer face coterminous with the second end of said end adapter casing;

(i.) a first bore of substantially constant diameter in said end adapter insulating core extending from its outer face to its inner face and confining therein said first lead pin, the terminal end of said first elongated external lead conductor, and a terminal portion of the jacketed length of said first elongated external lead conductor; and, (j.) a second bore of substantially constant diameter in said end adapter insulating core extending from its outer face to its inner face and confining therein said second lead pin, the terminal end of said second elongated external lead conductor, and a terminal portion of the jacketed length of said second elongated external lead conductor.

30. An electrical heater assembly according to claim 29 wherein said heating element housing comprises an elongated tubular structure.

31. An electrical heater assembly according to claim 29 wherein said first flat planar surface on said first lead pin faces in a first direction and said second flat planar surface on said second lead pin faces in a second direction 180° from said first direction.

32. An electrical heater assembly according to claim 29 wherein said first flat planar surface on said first lead pin faces in a first direction and another flat planar surface is located on said first lead pin facing in a second direction 180° from said first direction.

33. An electrical heater assembly according to claim 32 wherein said second flat planar surface of said second lead pin faces in said second direction and another flat planar surface is located on said second lead pin facing in said first direction.

34. An electrical heater assembly according to claim 29 wherein said terminal end of the first elongated external lead conductor is maintained in contact with said first lead pin by a method selected from the group consisting of brazing, soldering and welding.

35. An electrical heater assembly according to claim 34 wherein said terminal end of the second elongated external lead conductor is maintained in contact with said second lead pin by a method selected from the group consisting of brazing, soldering and welding.

36. An electrical heater assembly according to claim 29 wherein said end adapter casing has an outer dimension substantially equal to the outermost dimension of said heating element housing.

37. An electrical heater assembly according to claim 29 wherein said end adapter casing has a permanent set which has been retained after the release of compressive force which was imposed upon said casing, said end adapter insulating core underlying said casing is in a compressed state, and said insulating jacket on the terminal portion of the jacketed length of said first and second elongated external lead conductors are in a compressed state within said first and second bores as a result of said imposed compressive force.

* * * * *

UNITED STATES PATENT AND TRADEMARK OFFICE

CERTIFICATE OF CORRECTION

PATENT NO. : 5,034,595

DATED : July 23, 1991

INVENTOR(S) : Gary Grendys

It is certified that error appears in the above-identified patent and that said Letters Patent is hereby corrected as shown below:

Column 5, line 29, "lo by threading" should be --10 by threading--.

Column 5, line 36, "passed over" should be --passes over--.

Column 8, line 29, "to these" should be --to those--.

Column 8, line 44, "element and end" should be --element and said--.

Column 10, line 3, "contact with sad" should be --contact with said--.

Signed and Sealed this

Thirteenth Day of October, 1992

*Attest:*

DOUGLAS B. COMER

*Attesting Officer*

*Acting Commissioner of Patents and Trademarks*